US010825312B2

(12) United States Patent
Ziems et al.

(10) Patent No.: US 10,825,312 B2
(45) Date of Patent: Nov. 3, 2020

(54) MODULAR MULTI-SENSOR FIRE- AND/OR SPARK DETECTOR

(71) Applicant: MINIMAX GMBH & CO. KG, Bad Oldesloe (DE)

(72) Inventors: Bernd Ziems, Zarpen (DE); Hauke Dittmer, Fehmarn (DE); Dirk Siemer, Rethwisch (DE); Axel Grothoff, Neumünster (DE); Peter Zuelzer, Hamburg (DE); Arne Stamer, Siebenbäumen (DE); Pawel Wisniewski, Bad Oldesloe (DE); Bernd Hallwass-Fedder, Hamburg (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 0 days.

(21) Appl. No.: 16/072,849

(22) PCT Filed: Feb. 5, 2017

(86) PCT No.: PCT/EP2017/052480
§ 371 (c)(1),
(2) Date: Jul. 25, 2018

(87) PCT Pub. No.: WO2017/140518
PCT Pub. Date: Aug. 24, 2017

(65) Prior Publication Data

US 2019/0130716 A1 May 2, 2019

(30) Foreign Application Priority Data

Feb. 19, 2016 (DE) ..... 10 2016 202 585

(51) Int. Cl.
*G08B 17/00* (2006.01)
*G08B 17/12* (2006.01)
(Continued)

(52) U.S. Cl.
CPC ..... *G08B 17/10* (2013.01); *G08B 17/00* (2013.01); *G08B 17/113* (2013.01)

(58) Field of Classification Search
None
See application file for complete search history.

(56) References Cited

U.S. PATENT DOCUMENTS 4,455,487 A * 6/1984 Wendt ..... G08B 17/12 250/339.05
4,839,527 A 6/1989 Leich
(Continued)

FOREIGN PATENT DOCUMENTS

CN 101201962 A 6/2008
CN 101246628 A 8/2008
(Continued)

OTHER PUBLICATIONS

International Searching Authority, International Search Report in German & English translation in International Appln. No. PCT/EP2017/052480, dated Aug. 4, 2017, 17 pages.
(Continued)

*Primary Examiner* — John F Mortell
(74) *Attorney, Agent, or Firm* — Perkins Coie LLP

(57) ABSTRACT

A modular multi-sensor fire detector (300) that has an evaluation unit and a plurality of sensor heads (100) which are arranged locally at a distance from the evaluation unit and are connected to the evaluation unit in a signal-conducting manner, wherein the evaluation unit (200) can be connected in a signal-conducting manner to an alarm signal receiving device (301) which is locally at a distance.

23 Claims, 3 Drawing Sheets

(51) Int. Cl.
*G08B 17/10* (2006.01)
*G08B 17/113* (2006.01)

(56) References Cited

U.S. PATENT DOCUMENTS

| | | | | |
|---|---|---|---|---|
| 5,062,446 | A * | 11/1991 | Anderson | G05D 7/0635 137/468 |
| 5,315,232 | A * | 5/1994 | Stewart | G01R 29/12 324/457 |
| 5,450,066 | A * | 9/1995 | Brighenti | G08B 17/06 340/589 |
| 5,650,800 | A * | 7/1997 | Benson | G08B 25/14 340/3.54 |
| 5,966,077 | A * | 10/1999 | Wong | G08B 17/10 250/343 |
| 8,103,325 | B2 * | 1/2012 | Swedlow | A61B 5/14551 600/323 |
| 2005/0143133 | A1 * | 6/2005 | Bridgelall | H01Q 1/007 455/562.1 |
| 2005/0156731 | A1 * | 7/2005 | Chapman, Jr. | F24F 11/30 340/521 |
| 2007/0194944 | A1 | 8/2007 | Galera et al. | |
| 2010/0033334 | A1 * | 2/2010 | Luo | G08B 17/12 340/577 |
| 2011/0241877 | A1 | 10/2011 | Wedig et al. | |
| 2012/0319680 | A1 * | 12/2012 | Ueda | G01D 5/2451 324/207.25 |
| 2013/0033377 | A1 * | 2/2013 | Hoseit | G08B 17/06 340/539.22 |
| 2013/0300579 | A1 * | 11/2013 | Meah | G08C 23/04 340/870.28 |
| 2013/0315605 | A1 | 11/2013 | Meah et al. | |
| 2017/0155279 | A1 * | 6/2017 | Eckhardt | G06F 1/26 |

FOREIGN PATENT DOCUMENTS

| | | | |
|---|---|---|---|
| DE | 198 45 553 | C2 | 10/2003 |
| DE | 10 2006 055 617 | A1 | 5/2008 |
| EP | 1 052 607 | A1 | 11/2000 |
| JP | Hei 11-296768 | A | 10/1999 |

OTHER PUBLICATIONS

First Office Action and English translation, Chinese Application No. 201780011957.8, 27 pages (dated Dec. 16, 2019).

Office Action with English translation, Korean Application No. 10-2018-7025724, 11 pages (dated Mar. 26, 2020).

* cited by examiner

MODULAR MULTI-SENSOR FIRE- AND/OR SPARK DETECTOR

PRIORITY CLAIM AND INCORPORATION BY REFERENCE

This application is a 35 U.S.C. § 371 application of International Application No. PCT/EP2017/052480, filed Feb. 5, 2017, which claims the benefit of German Application No. 10 2016 202 585.6, filed Feb. 19, 2016, each of which is incorporated by reference in its entirety.

TECHNICAL FIELD

The invention relates to a modular multi-sensor fire detector and to a fire detection system having the same.

BACKGROUND AND SUMMARY OF THE INVENTION

Fire detectors and spark detectors are used in a generally known manner to monitor objects, for example machines, manufacturing processes, gas turbines, warehouses and the like, for the emergence of fire hazards. This is carried out by using sensors to detect hazard characteristic variables, so-called fire or spark characteristic variables. The prior art discloses fire detection systems in which one or else more fire detectors are installed in a room or in an area to be monitored. If the sensors installed in the fire detectors capture the respective fire characteristic variable, they transmit an alarm signal to an alarm signal receiving device. According to the invention, this is understood as meaning, for example, a gas detection control unit, a spark detection control unit, a fire detector control unit and/or an extinguishing control unit, a control unit for controlling non-extinguishing functions (for instance for switching off installations, for operating shut-off elements for material or energy flows, for opening and closing material discharge flaps) and the like.

According to the invention, a fire detector is understood as meaning a detector for detecting fire and/or hazard characteristic variables and for detecting sparks, wherein fire characteristic variables and/or hazard characteristic variables are understood as meaning, in particular, electromagnetic radiation, aerosols (in particular smoke aerosols), temperatures, gas concentrations, gas compositions and/or concentration changes of particular gaseous components of combustion gases, thermal decomposition products, toxic or flammable gases.

So-called two-stage systems, in which the fire detector is arranged in the hazardous area, whereas the alarm signal receiving device is positioned at another location which is sometimes far away, are therefore known.

Multi-sensor fire detectors, in which a plurality of sensors are permanently installed in a housing together with an evaluation unit, are also known. In this case, the disadvantage is considered to be the fact that, if even one part, for example one of the sensors, fails, the entire detector must be exchanged and no monitoring can take place for this period. The field of application of such detectors is also highly limited.

In order to perform the necessary technical functions, evaluation electronics are also installed in a fire detector according to the prior art in addition to the pure sensor system. Since fire detectors have to be fitted in or at least very close to the hazardous area in order to be able to reliably ensure that hazards are detected, the fire detectors must meet high safety requirements and environmental requirements, for example with regard to their suitability for use in potentially explosive areas (flameproofness), their resistance to high temperatures, electromagnetic radiation, or tightness with respect to the ingress of fluid (gaseous or liquid). Depending on the working environment, the fire detectors must also be dustproof.

Accommodating the fire detectors in housings which are accordingly classified to be safe requires a large amount of structural effort and, with regard to the approval, a large amount of formal expenditure.

Furthermore, not only one hazard source but a plurality of potential hazard sources need to be monitored in particular rooms, or more than one fire detector is needed to be able to reliably determine the occurrence of a hazardous event. The latter is known as multi-detector dependence in the prior art. A first detector signals a hazard which must first of all also be verified by a second detector of the same type or of another type before the presence of a fire and/or spark hazard can be inferred. This analysis of the signals from a plurality of detectors is carried out in the prior art by the alarm signal receiving device, which requires a large amount of effort there. In addition, the installation expenditure of such a multi-detector system and its coordination with the alarm signal receiving device are perceived to be disadvantageous. This applies, in particular, in complex objects to be monitored having a multiplicity of areas to be monitored and an accordingly large number of detectors.

Against this background, it as an object of the invention to specify a fire detector which overcomes the disadvantages found in the prior art to the greatest possible extent. In particular, the invention was based on the object of specifying a fire detector which provides undiminished high protection of the sensors from environmental influences in the hazardous areas with favorable system costs. The invention was also based, in particular, on the object of specifying a fire detector which can be installed in fire detection systems with little effort and, in particular, can be retrofitted, maintained and rededicated for capturing other hazard characteristic variables. The invention was also based, in particular, on the object of proposing a fire detector which can be flexibly handled with respect to its installation and can be installed, in particular, in particularly confined conditions, for example in the object protection of machine tools.

The invention achieves the object on which it is based by proposing a modular multi-sensor fire detector as claimed in claim 1. The modular multi-sensor fire detector has an evaluation unit and a plurality of sensor heads which are arranged spaced-apart from the evaluation unit and are in signal communication with the evaluation unit, wherein the evaluation unit is configured to be in signal communication with a spaced-apart alarm signal receiving device, such that the evaluation unit, the sensor heads and the alarm signal receiving device are not integrated into the common housing or into a plurality of housings mounted together.

The invention therefore uses the knowledge that the protection of the sensor head arranged directly in the hazardous area is given a higher priority than the protection of the evaluation unit which need not necessarily be arranged in the hazardous area. Following this approach, the sensor heads are spatially remote from the evaluation unit according to the invention. This immediately has several advantages: on the one hand, on account of their separation from the evaluation unit, the sensor heads allow a considerably more compact design than the prior art and can be installed at locations where conventional detectors cannot be used. On the other hand, the flexibility of use and the maintainability are increased; the evaluation unit which is locally remote both from the sensor head and from the alarm signal receiving device converts the detector architecture into a three-stage system in which the sensor head constitutes the first stage, the evaluation unit constitutes the second stage and the alarm signal receiving device constitutes the third stage of a fire detection system.

"Locally remote" is understood as meaning the fact that the elements designated in this manner are structurally separated from one another, in particular are not integrated in a common housing or in a plurality of housings installed together, and are spatially at a distance from one another.

According to the invention, it is now possible to respectively protect only the sensor heads from environmental influences according to the local requirements, whereas a standard housing can be used for the evaluation unit itself for all applications, while sensor heads used in hazardous areas are particularly well protected, for example by means of housings which are explosionproof, dustproof and/or protected from the ingress of gas or with a high IP protection class. This considerably reduces the component complexity and results in a more favorable cost balance for the overall system.

According to the invention, the evaluation unit is configured to be optionally connected to a plurality of sensor heads of different or identical types in a signal-conducting manner. This significantly increases the flexibility of the fire detector according to the invention to the effect that the same evaluation unit can always be used in conjunction with a respectively locally required combination of sensor heads.

According to the invention, the evaluation unit is preferably configured to transmit an alarm signal adapted to the communication with the alarm signal receiving device to the latter irrespective of the sensor head which is used and is compatible with it. This considerably reduces the configuration and programming effort by the alarm signal receiving device. Irrespective of which sensors are used, the appropriate signal is always transmitted to the alarm signal receiving device when there is a hazard. In this manner, the evaluation unit, as the upstream signal processing or interpretation unit, evaluates the alarm signals transmitted by the sensor heads. The technical effect of such "distributed intelligence" reduces response times since the load on the alarm signal receiving unit is relieved by the upstream decentralized evaluation unit.

The invention is developed further in that the evaluation unit has a plurality of first interfaces for signal communication of the evaluation unit with the sensor heads and at least one second interface signal communication of the evaluation unit to the alarm signal receiving device. With regard to the alarm signal receiving device, reference is made to the definition above.

The evaluation unit is preferably configured for bidirectional data transmission by means of the first and/or second interface. This is understood as meaning that the interfaces themselves are therefore also configured for the above-mentioned bidirectional data transmission. This is also understood as meaning that the sensor head and/or the alarm signal receiving device are also each configured for bidirectional data transmission by means of a corresponding interface. The bidirectionality of the data transmission does not merely make it possible to send hazard signals from the sensor heads in the direction of the evaluation unit and to send corresponding alarm signals from the latter in the direction of the alarm signal receiving device, but also conversely makes it possible to transmit information from the alarm signal receiving device to the evaluation unit and from the evaluation unit to the sensor heads.

In another preferred embodiment of the detector according to the invention, the evaluation unit is configured to interpret hazard signals received from the sensor heads by means of the first interfaces for the presence of an alarm situation and, if an alarm situation is present, to generate an alarm signal representative of the alarm situation and to transmit it to the alarm signal receiving device by means of the second interface. For this purpose, the evaluation unit preferably has an accordingly programmed computer unit.

The evaluation unit is also preferably configured to interpret the hazard signals on the basis of one or more configuration parameters. The configuration parameters are preferably stored in the evaluation unit, and/or the evaluation unit is configured to receive the configuration parameters by means of the second interface and/or by means of a dedicated third interface. The configuration parameters are used to "teach" the evaluation unit how to deal with a wide variety of sensor heads by virtue of the configuration parameters defining how the evaluation unit needs to interpret the hazard signals received from the respective sensor heads.

The configuration parameters preferably comprise one, a plurality of or all of the following:

- number of sensor heads,
- type or types of sensor heads,
- one or more threshold values of the hazard signals transmitted by the sensor heads, as a result of the exceeding of which the evaluation unit registers the hazard signal from the respective sensor head,
- number of required hazard signal registrations by the sensor heads, as a result of which the evaluation unit transmits an alarm signal by means of the second interface,
- required temporal sequence of the hazard signal registrations, on account of the occurrence of which the evaluation unit transmits an alarm signal by means of the second interface,
- range of a required interval of time, preferably a maximum interval of time, between a plurality of hazard signal registrations, on account of the compliance with which the evaluation unit transmits an alarm signal by means of the second interface.

In another preferred embodiment, the evaluation unit is configured to receive, preferably by means of the second interface, at least one of: firmware, configuration data, control commands, respectively, for the sensor heads, and preferably to forward the received data to the sensor heads. Configuration data are understood as meaning, for example, threshold values for a measured characteristic variable, above which a hazard signal is generated, or threshold values, after the reaching of which a malfunction of the sensor head is detected, for example the degree of soiling for optical sensors.

As an alternative to the second interface, the evaluation unit is preferably configured to receive the above-mentioned elements by means of the third interface.

In another preferred configuration, at least one of the sensor heads is configured to carry out a function self-test depending on the reception of a corresponding control command and to store an information element representative of the passing or failing of the function self-test, for example in the form of a file or a discrete value, tag etc., in a memory and/or to transmit it to the evaluation unit. The control commands also preferably comprise a command to carry out the function self-test. The available configuration data, for example, are used for this purpose.

The detector according to the invention is developed by virtue of the fact that the sensor head or at least one of the sensor heads has a data memory and is configured to store at least one of the measured fire or hazard variable values in the data memory, wherein the control commands comprise a command to do at least one of: read or reset the data memory.

The sensor head is preferably configured to do at least one of:

- to store a predetermined number of fire and/or hazard variable values captured last, or
- to store the maxima and/or minima of the captured fire and/or hazard variable values each with a time stamp in a value history in the data memory.

In addition to its main sensor for capturing the fire and/or hazard characteristic variables or sparks, the sensor head preferably has a temperature sensor for capturing the temperature inside the sensor head and is also preferably configured to do at least one of:

- to store a predetermined number of temperature values captured last from inside the sensor head, or
- to store the maxima and/or minima of the captured temperature inside the sensor head each with a time stamp in a value history in the data memory.

Examples of a value history are, inter alia, the current temperature inside the sensor head, the minimum and/or maximum temperature to which the sensor head was exposed, minimum and/or maximum smoke aerosol, gas and/or radiation concentrations.

The practice of capturing and storing the temperatures which have occurred at the sensor head makes it possible to create a temperature history which is used to document when the sensor head was exposed to which temperatures. With increasing temperatures, the sensors installed in the sensor heads sometimes age in an accelerated manner depending on the type. A sensor which has already been exposed to high temperatures more frequently will accordingly possibly have a somewhat different response behavior to a sensor which has not yet been exposed to this. By reading the temperature value memory, an operator, for instance maintenance personnel, or preferably the evaluation unit itself can discern whether the sensor head can still be used or must be changed. The resetting of the temperature value memory is advantageously used when the sensor head has been repaired again, for example by changing a sensor array or the like.

The sensor head is also preferably configured to register predetermined events and to store each of them with a time stamp as an event history in the data memory (or a dedicated data memory).

The following come into consideration, for example, as predetermined events: the number of functional tests which have been carried out, the number of self-calibrations which have been carried out, the number of maintenance operations which have been carried out, the number of faults which have occurred, the number of hazard signal reports in the past, and operations of resetting the value history and/or the event history.

In another preferred embodiment, the sensor head or at least one of the sensor heads is configured to carry out a self-calibration on the basis of the reception of a corresponding control command, wherein the control commands comprise a command to carry out the self-calibration. Within the scope of the self-calibration of the sensor head, threshold values which are stored in the sensor head and are intended to trigger a hazard signal are preferably adapted to those background characteristic variables which are already present in the absence of the fire characteristic variable and are detected by the sensor head. For this purpose, the sensor head is preferably designed to execute a program routine which is used to capture background disturbance variables, for example the ambient temperature, a basic level of electromagnetic radiation, a gas concentration or concentration values of different gases, smoke particle concentrations, inter alia. The background disturbance variables are preferably stored in a memory of the sensor head and/or of the evaluation unit. The sensor head is preferably configured, within the scope of the self-calibration, to stipulate threshold values and/or select sensitivity levels of the sensor system on the basis of the background disturbance variables, which causes the changeover to predefined sensitivity levels, in particular. The sensor head is also preferably configured to store the previously stipulated threshold values of the background disturbance variables and/or the sensitivity levels which have been set in a memory.

The evaluation unit or the sensor head or at least one of the sensor heads is also preferably configured to reset the value history and/or the event history in the data memory on the basis of the reception of a corresponding control command (B), wherein the control commands comprise a command to carry out the reset.

In another preferred embodiment of the detector, the evaluation unit, in particular its computer unit, is configured to transmit a request signal to the sensor heads by means of the first interfaces and to receive sensor head data from a memory of the sensor heads in response to the request signal.

The sensor head data comprise, in particular, one, a plurality of or all of the following: the sensor type, a sensor ID, manufacturing data relating to the sensor head, the software or firmware version used by the sensor head, status data relating to the sensor, for instance accumulated operating hours, maintenance intervals, remaining number of operating hours before reaching the next maintenance interval, configuration data relating to the sensor head, the value history and/or the event history from the data memory of the sensor head.

The evaluation unit is preferably configured to identify the sensor heads connected by means of the respectively discussed interface depending on the received sensor head data. This makes it possible to connect an accordingly preconfigured evaluation unit to the respectively required sensor heads in a signal-conducting manner by means of plug and play at the location of use, whereupon the evaluation unit preferably automatically identifies the connected sensor heads and configures itself.

The embodiment of the detector according to the invention having a third interface is preferably developed further in that the third interface is configured to connect at least one of a configuration device, in particular a portable computer, a tablet, a proprietary service device or a mobile telephone, for at least one of supplying, reading or processing the following: configuration parameters, sensor head data, configuration data, contents of the data memory of the sensor head, firmware, control commands. In this case, the connection is understood as meaning the signal-conducting connection for interchanging data, which can be effected both in a wired and in a wireless manner.

Alternatively or additionally, the evaluation unit is configured to receive one, a plurality of or all of the following from the alarm signal receiving device by means of the second interface: configuration parameters, sensor head data, configuration data, firmware, control commands, wherein the alarm signal receiving device is preferably configured to supply, read and/or process the above-mentioned elements.

The evaluation unit is preferably configured to forward at least the configuration data and/or the firmware and/or the control commands to the sensor head.

As an alternative or in addition to configuring the evaluation unit by means of the configuration parameters which from the second or third interface or one of the further interfaces, the detector preferably has one or more hardware switches, preferably DIP switches and/or coded rotary switches, for manually selecting the configuration parameters for the first interfaces, to which the sensor heads are to be connected.

In one particularly preferred embodiment, the evaluation unit, in particular a computer unit integrated in the evaluation unit, is configured to carry out a configuration mode for identifying the sensor heads connected to the evaluation unit and preferably for automatically selecting suitable configuration parameters on the basis of the identification of the connected sensor heads. The computer unit is preferably programmed by means of corresponding software. The evaluation unit also preferably has at least one switching element which can be controlled from the outside, in particular manually, and is intended to activate, preferably start, and preferably terminate, the configuration mode, wherein the switching element is designed, for example, as a magnetic field sensor, a pushbutton or a magnetically actuated reed contact.

The configuration mode described below shows the advantages of the modular multi-sensor concept according to the invention. The configuration mode constitutes a method which, in particular when carried out on a fire detector according to one of the preferred embodiments described above and below, both constitutes a preferred embodiment of the fire detector as a function of the evaluation unit implemented using programming, and forms an independent aspect of the invention.

In this case, the configuration mode preferably comprises the following steps of:

- providing, preferably transmitting, configuration parameters to the evaluation unit, for example by means of a configuration device, for each of the first interfaces, to which a sensor head is intended to be connected;
- activating the configuration mode;
- connecting the sensor heads to the evaluation unit by means of those interfaces for which configuration parameters have been provided;
- reading the sensor head data, for example automatically or by transmitting a request signal Sreq from the evaluation unit to the sensor heads;
- checking whether the sensor head data which have been read correspond to the respective configuration parameters for the respective first interface;
- outputting a confirmation signal if the respective configuration parameters and sensor head data correspond for each of the sensor head interfaces, or outputting a fault signal if the respective configuration parameters and sensor head data do not correspond,
- terminating the configuration mode, and
- changing to the operating mode.

The operating mode is understood as meaning that the sensor heads are operating and detect fire and/or hazard characteristic variables or spark characteristic variables and the evaluation unit is ready to receive hazard signals at the first interfaces.

The sensor heads are preferably first of all connected before the configuration mode is activated.

In one preferred configuration, the evaluation unit is configured to continue the operating mode if there is a fault signal from one or more sensor heads in the operating mode and to wait for hazard signals from those sensor heads which do not report a fault.

In an operating mode in which a multi-detector dependence is predefined by means of the configuration parameters, the evaluation unit is also preferably configured to cancel the multi-detector dependence if there is a fault in one of the sensor heads included in the multi-detector dependence and, in a single-detector dependence, to wait for hazard signals from those sensor heads which do not report a fault.

In another preferred embodiment, the evaluation unit is configured to report a fault signal after a sensor head reporting a fault has been removed. In this case, the evaluation unit is preferably additionally configured to acknowledge the fault signal itself if a sensor head of the same type is connected instead of the previously removed sensor head.

The evaluation unit is preferably configured to output a request signal to acknowledge the fault signal and to identify the connected sensor head again if a sensor head of a different type is connected instead of the previously removed sensor head.

Alternatively, the evaluation unit is configured to acknowledge the fault signal itself and to automatically identify the connected sensor head again if a sensor head of a different type is connected instead of the previously removed sensor head.

The configuration mode is preferably terminated a) automatically as soon as there is a confirmation signal for at least one connected sensor head, preferably for each of the connected sensor heads, and there is no fault signal, preferably within a predetermined period after the start of the configuration mode, or b) automatically as soon as there is preferably a fault signal for all connected sensor heads, or c) manually.

At least the following should be provided as configuration parameters: the number of those first interfaces which are intended to be used to connect a sensor head to the evaluation unit in a signal-conducting manner and preferably the respective sensor type for the corresponding first interface. The fire and/or spark detector architecture described on the basis of the embodiments above is configured to be used with a multiplicity of different sensor heads in any desired combination. The sensor heads of the detector according to the invention preferably have at least one housing, a (main) sensor and an interface for transmitting hazard signals and are configured to capture electromagnetic radiation from sparks and/or flames, to capture a temperature, preferably the ambient temperature or the housing temperature inside the sensor head, to capture gas concentrations and/or gas compositions and/or concentration changes of particular gaseous components of combustion gases, thermal decomposition products, toxic or flammable gases or aerosols, in particular smoke aerosols.

Particularly preferred combinations of sensor heads on the fire and/or spark detector according to the invention are:

a) two or more spark sensor heads, b) two or more flame detector sensor heads, c) two or more temperature sensor heads, d) two or more gas sensor heads, e) one of variants a) to c) in combination with one or more gas sensor heads, f) one of variants a), b) and d) in combination with one or more temperature sensor heads, g) one of variants a), c) and d) in combination with one or more flame detector sensor heads, h) one of variants b) to d) in combination with one or more spark sensor heads, i) a spark sensor head in combination with a flame detector sensor head and a temperature sensor head, j) a spark sensor head in combination with a flame detector sensor head and a gas sensor head, k) a flame detector sensor head in combination with a temperature sensor head and a gas sensor head, l) a temperature sensor head in combination with a spark sensor head and a gas sensor head.

As becomes clear from the examples above, the system architecture provides flexible adaptation to different protective concepts and makes it possible to capture a wide variety of fire characteristic variables on the basis of the risk of fire in the respective environment. For example, flexible adaptation is enabled for a wide variety of manufacturing processes, types of material storage or material transport and the material, for example, even when monitoring logistical processes in factories. In another preferred embodiment of the detector, the sensor heads each have a signal processing unit which is configured to normalize the hazard signal and to transmit it as a normalized sensor head output signal to the evaluation unit. In this case, the hazard signal is preferably converted into a discrete value, for example 0 or 1, wherein the respective converted discrete value represents a hazard or no hazard. Using the example of 0 and 1, the discrete value 0 represents "no hazard", for example, whereas the discrete value 1 represents "hazard". The normalization in the sensor head simplifies the signal and data processing by the evaluation unit and standardizes the signal output for the sensor heads. The evaluation unit must then be configured to a lesser extent since it "knows" from the outset that only the normalized values for "hazard" or "no hazard" are transmitted to it by the sensor heads.

The invention also relates to a fire detection system. In a similar manner to the multi-sensor fire detector, this is understood as meaning a fire and/or spark and/or gas alarm system according to the invention.

The invention achieves the object on which it is based and which was described at the outset in a fire detection system by virtue of the latter having at least one modular multi-sensor fire detector according to one of the preferred embodiments described above and an alarm signal receiving device which is in signal communication with the modular multi-sensor fire detector in a signal-conducting manner and is spaced-apart from it. With regard to the advantages and preferred embodiments of the fire detection system, reference is made to the preferred embodiments and explanations of the detector according to the invention further above. Particularly the possibility of combining various sensor heads and allowing this combination to appear, in terms of signaling, as a detector with respect to the alarm signal receiving device in the fire detection system is a solution with excellent flexibility. This becomes clear from the following example: in the case of flying sparks or flying glowing particles in industrial processes and elsewhere, the sparks or particles are sometimes not detected on account of the fact that they are quickly extinguished. Nevertheless, a smoldering fire can result, which would not be detected with a pure spark detector. However, if a spark sensor head, for example, is operated in combination with a combustion gas sensor head in the fire detection system, a fire alarm can still be transmitted despite the sparking or glowing particle not being detected by means of the gas detection.

BRIEF DESCRIPTION OF THE DRAWINGS

The invention is described in more detail below on the basis of a preferred exemplary embodiment with reference to the accompanying figures, in which.

MODE(S) FOR CARRYING OUT THE INVENTION

Figure 1:
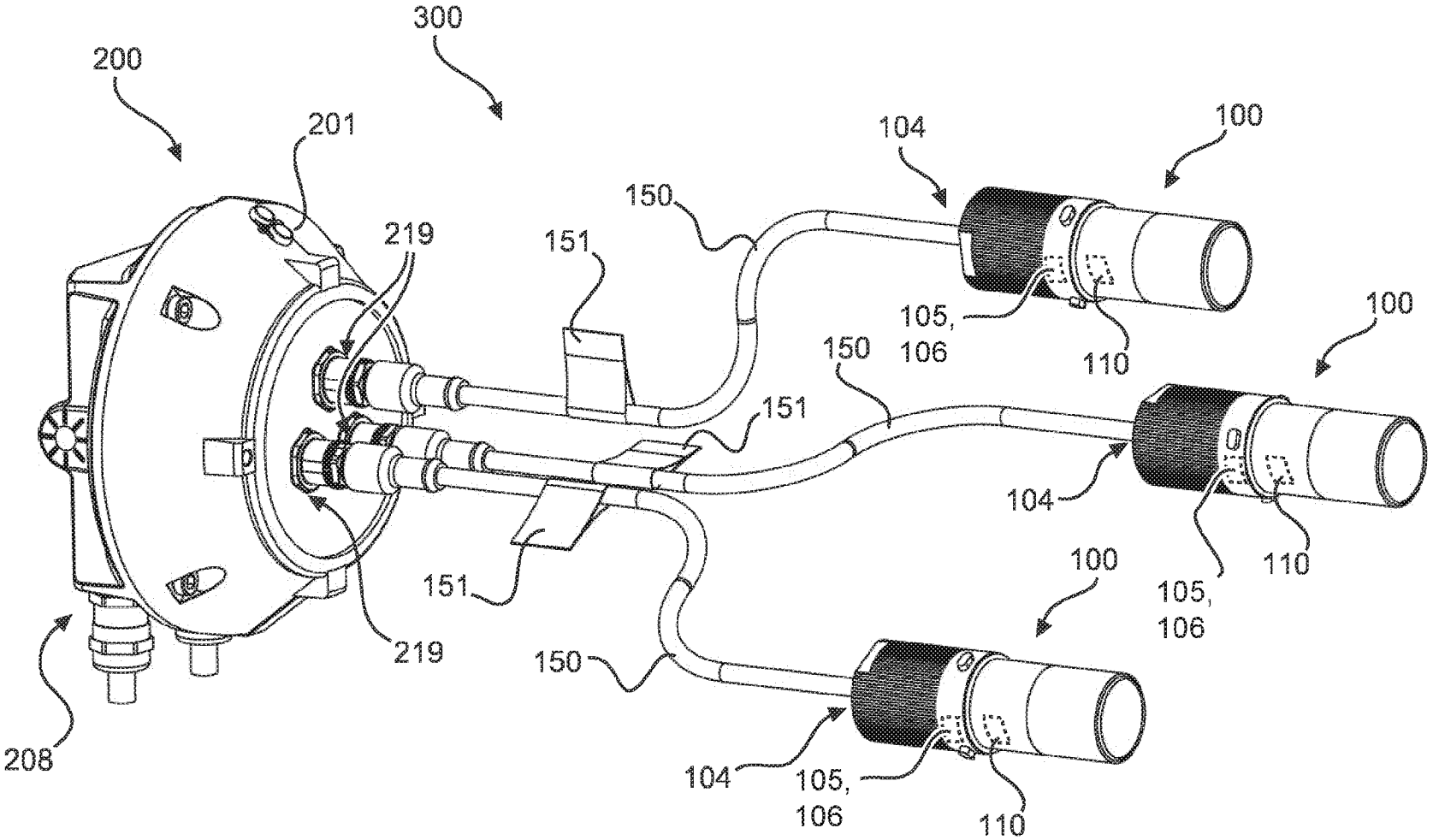
FIG. 1 shows a schematic illustration of the detector according to one preferred exemplary embodiment of the invention.

FIG. 1 shows a modular multi-sensor fire and/or spark detector 300 (detector 300 below). The detector 300 has a plurality of sensor heads 100 which are each configured to capture a fire characteristic variable, for example to capture electromagnetic radiation, gas, smoke and/or temperatures. For the sake of simplicity, the sensor heads 100 are all illustrated as being the same, but may be sensor heads of different types.

In addition to the sensor heads 100, the detector 300 has an evaluation unit 200 which is locally at a distance. The evaluation unit 200 is connected in a signal-conducting manner to the sensor heads 100 which are in turn locally at a distance from it, by means of a data line 150 in the present exemplary embodiment. The data line is preferably used as an energy supply for the sensor heads. Alternatively, the signal-conducting connection between the evaluation unit 200 and the sensor heads 100 could also be wireless, wherein the sensor heads in that case have a dedicated energy supply. The evaluation unit 200 has a plurality of first interfaces 219 which are used to connect the sensor heads 100 to the evaluation unit 200 in a signal-conducting manner. For this purpose, the sensor heads 100 each have a corresponding interface 104. The distances between the sensor heads and the evaluation unit are preferably 20 cm or more, in particular up to several meters. The distance between the evaluation unit and the alarm signal receiving device is not subject to any limits within the scope of possible types of remote data transmission.

Whereas the sensor heads 100 preferably have a flame-proof and dust-tight and liquid-tight housing and have a particularly compact design which enables installation in confined monitoring areas, for example machine tools, the evaluation unit 200 has a larger housing 201 in a comparatively lower protection class than the sensor heads 100. The evaluation unit 200 also has a second interface 208 which is designed for data transmission, preferably bidirectional data transmission, with an alarm signal receiving device (301) (see FIG. 3). In the exemplary embodiment shown, the second interface 208 is simultaneously the current or voltage supply for the evaluation unit 200. However, alternatively or additionally, further second interfaces, which ensure wireless communication with the alarm signal receiving unit 301 (cf. FIG. 3) for example, are also advantageous.

In addition to their main sensor for capturing one of the fire or hazard characteristic variables cited further above or sparks, the sensor heads preferably each comprise a temperature sensor 110 which is configured to capture the temperature inside the housing of the sensor heads 100. The sensor heads are preferably also designed with a data memory 105. The sensor heads 100 also have a signal processing unit 106. In accordance with the preferred embodiments generally described further above, the data memory 105 also stores a value history and/or an event history.

The data lines 150 preferably each have an identification label 151 which stores operator information, for example the type of data line or the type of connected sensor head 100.

Figure 2A:
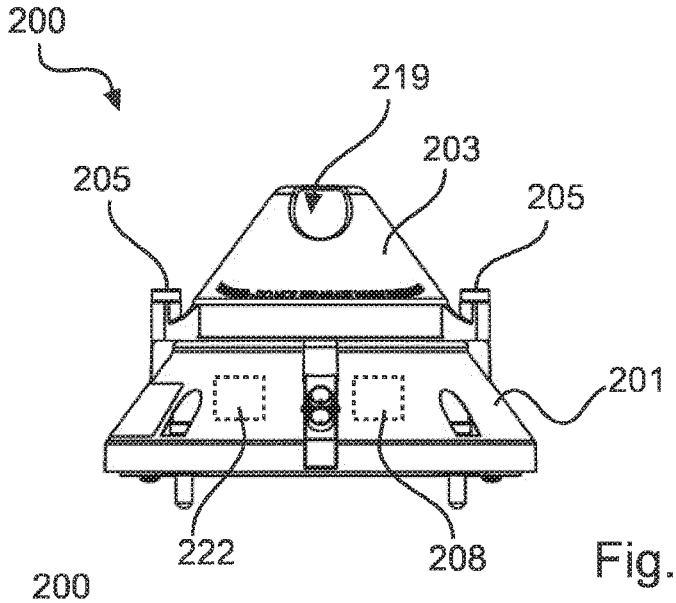
FIGS. 2*a-c* show various views of an evaluation unit of the detector according to FIG. 1.
Figure 2B:
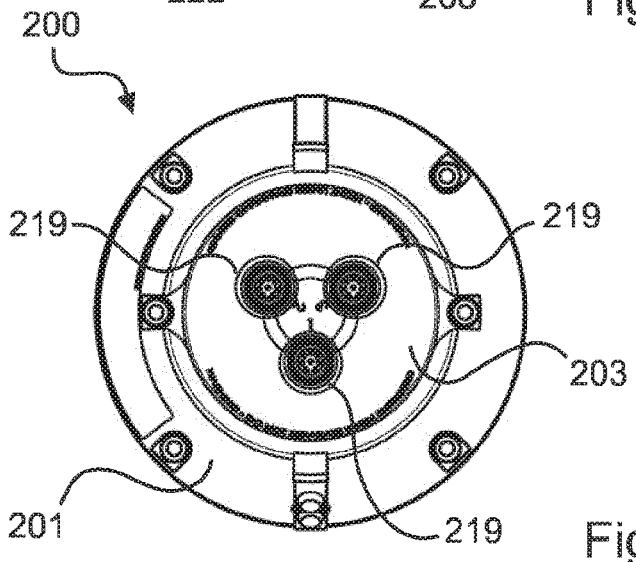
Figure 2C:
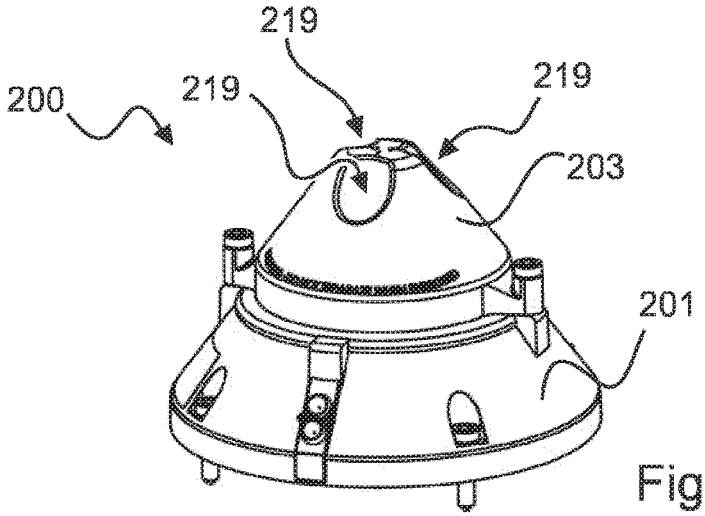

FIGS. 2*a-c* show the evaluation unit 200 in a plurality of views. In addition to the illustration according to FIG. 1, FIGS. 2*a-c* show a protective cap 203 which is fitted to the housing 201 on the side of the first interfaces 219. The protective cap 203 protects against unintentional release of the data lines from the first interfaces 219 and protects the connection against the external application of force (for instance impacts, strikes). The protective cap 203 is captively fastened to the housing 201 by means of fastening means 205, preferably screw connections. In addition to the second interface 208, FIG. 2*a* indicates a third interface 222. The third interface 222 is configured to communicate with a configuration device, for example a portable computer, a tablet, a service device or a mobile telephone, in a signal-conducting manner, preferably in a bidirectional manner.

Figure 3:
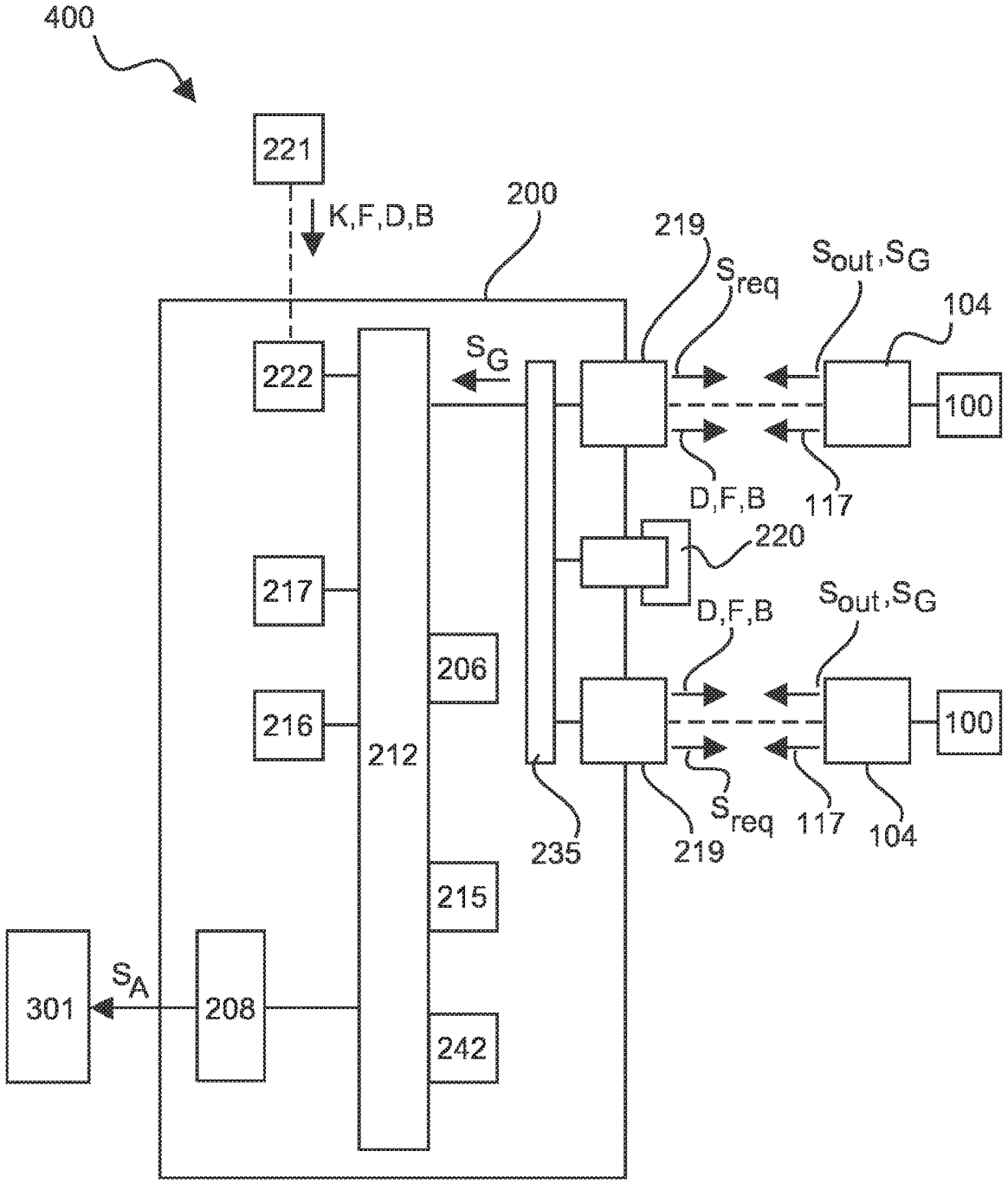
FIG. 3 shows a schematic illustration of a fire detection system according to one preferred exemplary embodiment of the invention.

More details of the data communication operations emerge from FIG. 3 which is described below. FIG. 3 schematically shows the structure of a fire detection system 400. In addition to the detector 300, the evaluation unit 200 and the sensor heads 100, the fire detection system 400 also comprises the alarm signal receiving device 301 which is preferably designed according to the preferred embodiments described further above. The evaluation unit 200 is locally at a distance from the alarm signal receiving device 301 which is designed as a fire detector control unit and/or an extinguishing control unit in this exemplary embodiment.

The evaluation unit 200 is preferably configured using one or more hardware switching elements 242, for example DIP switches, and/or using the third interface 222. The third interface 222 preferably receives one, a plurality of or all of the following from a configuration device 221, for instance a portable computer, a tablet, a service device or a mobile telephone: configuration parameters K, firmware F, configuration data D, control commands B. The received elements are processed by an electronic assembly 212 comprising a computer unit 206, for example in the form of a microcontroller, and/or are forwarded to the sensor heads 100 by means of the first interfaces 219. This applies, in particular, to any firmware data F, configuration data D for configuring the sensor heads 100 or control commands B for controlling the sensor heads 100, for example for self-function tests or self-calibration measures. Alternatively, the elements K, F, D and B could also be loaded by means of the third interface 222 and/or from the alarm signal receiving device 301 and via the second interface 208 provided that the respective interfaces are configured for bidirectional data transmission.

By means of the electronic assembly 212 and the computer unit 206, the evaluation unit 200 is configured to store the received configuration parameters K in a memory 215 and to configure the first interfaces 219 on the basis of the configuration parameters K. The first interfaces 219 are preferably configured at least to the effect that the evaluation unit 300 assigns, for each of the first interfaces 219, whether a sensor head 100 is intended to be connected to the interface for operation and preferably the type of sensor head 100 which is intended to be connected. The evaluation unit 200 is also configured to generate an alarm signal SA on the basis of the configuration parameters K if hazard signals SG or normalized hazard signals Sout are received by the first interfaces 219 in a predefined constellation. Different constellations may be the following, for example:

A prescribed sequence of the signal inputs at the first interfaces 219, a prescribed (maximum) interval of time between the signal inputs at the first interfaces 219, the number of required signal inputs at the first interfaces 219.

First interfaces 219 which are not intended to be used during operation are preferably closed by means of a closure cap 220.

The configuration of the detector 300 in the fire detection system 400 is intended to be described below. In order to install the detector 300 in a room to be monitored, one or more configuration parameters K are initially provided, either directly by means of the hardware switching elements 242, from the memory 215 of the evaluation unit 200 or by means of the third interface 222. A configuration mode is additionally started in the evaluation unit 200, either by means of the configuration device 221 via the third interface 222 or using one or more separate switching elements 216, 217 which can be controlled from the outside, in particular manually, and are preferably designed as magnetically actuatable reed contacts. After the configuration mode has been started, the evaluation unit 200 transmits a request signal Sreq via those first interfaces 219 which are allocated to a sensor head 100 by means of the configuration parameters K via those first interfaces 219. If the request signal Sreq is received by the sensor heads 100 via the interface 104, the sensor heads 100 transmit sensor head data 117 to the first interfaces 219. If the signal Sreq does not pass through to the sensor heads 110, a fault signal is generated.

The evaluation unit is configured to compare the sensor head data received from the sensor heads 100 with the configuration parameters K previously made available to it. If the sensor head data 117 for the respective sensor head 100 correspond at the respective first interface 219, that is to say that sensor head which was previously allocated by means of the configuration parameters K is actually connected to the first interface 219, the evaluation unit 200 preferably generates a confirmation signal or an information element.

If confirmation signals or information elements are present for all first interfaces 219 previously configured by means of the configuration parameters K for connecting sensor heads 100, the configuration mode is preferably automatically terminated and the process changes to the operating mode. If a fault signal is present, the operator is notified of this, preferably by means of an optical and/or acoustic indication, and the configuration mode is likewise terminated, but without changing to the operating mode.

A fault signal is preferably not only generated when sensor head data are not transmitted to the evaluation unit 200 but also when, although sensor head data 117 have been transmitted, they do not correspond to the previously provided configuration parameters K for the respective first interface 219.

As emerges from the explanations above, the invention provides a particularly simple possibility for installing a complex modular multi-sensor fire and/or spark detector system. The configuration and interpretation of the hazard signals provided by the sensor heads are preferably automatically carried out by the evaluation unit, with the result that the very complex multi-sensor detector communicates like an individual detector to the outside, that is to say with respect to the alarm signal receiving device 301. In particular in the case of complex objects having a multiplicity of areas to be monitored and a large number of detectors used, this ensures that the load on the alarm signal receiving device is considerably relieved. In addition, the multi-sensor fire detector according to the invention displays the strength of its compact design and distributed architecture in confined environments.

LIST OF UTILIZED REFERENCE NUMBERS

Sensor heads 100
Sensor head interface 104
Central data memory 105
Signal processing unit 106
Temperature sensor 110
Sensor head data 117
Data line 150
Identification label 151
Evaluation unit 200
Housing 201
Protective cap 203
Fastening means 205
Computer unit 206
Second interface 208
Electronic assembly 212
Memory 215
Switching elements 216, 217
First interface 219
Closure cap 220
Configuration device 221
Third interface 222
Hardware switching elements 242
Detector 300
Alarm signal receiving unit 301
Fire detection system 400
Configuration parameters K
Firmware F
Configuration data D
Control commands B
Alarm signal $S_A$
Hazard signals $S_G$
Normalized hazard signals $S_{out}$
Request signal $S_{req}$

The invention claimed is:

1. A modular multi-sensor fire detector, comprising:
an evaluation unit disposed within a housing, and
a plurality of sensor heads, each of the plurality of sensor heads including a housing, each housing of each of the plurality of sensor heads are spaced-apart and are arranged spaced-apart from the housing of the evaluation unit, and each of the plurality of sensor heads are in signal communication with the evaluation unit,
wherein the evaluation unit is configured to be in a signal communication with a spaced-apart alarm signal receiving device, such that the evaluation unit, the sensor heads, and the alarm signal receiving device are not integrated into one common housing or into a plurality of housings mounted together, and
wherein each housing of each of the plurality of sensor heads comprises a first protection class and the housing of the evaluation unit comprises a second protection class, the second protection class being lower than the first protection class.

2. The detector as claimed in claim 1,
wherein the evaluation unit has a plurality of first interfaces for signal communication with the sensor heads and at least one second interface for signal communication with the alarm signal receiving device.

3. The detector as claimed in claim 2,
wherein the evaluation unit is configured for bidirectional data transmission by the first and/or second interface.

4. The detector as claimed in claim 2, wherein the evaluation unit is configured to interpret hazard signals received from the sensor heads by the plurality of first interfaces for the presence of an alarm situation and, if an alarm situation is present, to generate an alarm signal representative of the alarm situation and to transmit it to the alarm signal receiving device by the at least one second interface.

5. The detector as claimed in claim 4,
wherein the evaluation unit is configured to interpret the hazard signals on the basis of one or more configuration parameters.

6. The detector as claimed in claim 5,
wherein the configuration parameters are stored in the evaluation unit, and/or wherein the evaluation unit is configured to receive the configuration parameters by the at least one second interface and/or by a dedicated third interface.

7. The detector as claimed in claim 5,
wherein the configuration parameters comprise at least one of the following:
number of sensor heads,
type or types of sensor heads,
one or more threshold values of the hazard signals transmitted by the sensor heads, as a result of the exceeding of which the evaluation unit registers the hazard signal from the respective sensor head,
number of required hazard signal registrations by the sensor heads, as a result of which the evaluation unit transmits an alarm signal by means of the second interface,
required temporal sequence of the hazard signal registrations, on account of the occurrence of which the evaluation unit transmits an alarm signal by the at least one second interface,
range of a required interval of time, preferably a maximum interval of time, between a plurality of hazard signal registrations, on account of the compliance with which the evaluation unit transmits an alarm signal by the at least one second interface.

8. The detector as claimed in claim 1, wherein the evaluation unit is configured to receive at least one of: firmware, configuration data, control commands, respectively, for the sensor heads, and to forward the received data to the sensor heads.

9. The detector as claimed in claim 8,
wherein at least one of the sensor heads is configured to carry out a function self-test depending on the reception of a corresponding control command and to store an information element representative of the passing or failing of the function self-test in a memory and/or to transmit it to the evaluation unit, and wherein
the control commands comprise a command to carry out the function self-test.

10. The detector as claimed in claim 8,
wherein the sensor head or at least one of the sensor heads has a data memory and is configured to store at least one of a measured fire or a hazard characteristic variable in the data memory, and wherein the control commands comprise a command to do at least one of: read or reset the data memory.

11. The detector as claimed in claim 10,
wherein the sensor head is configured to do at least one of:

store a predetermined number of fire and/or hazard variable values captured last, or store the maxima and/or minima of the captured fire and/or hazard variable values each with a time stamp in a value history in the data memory.

12. The detector as claimed in claim 10, wherein the sensor head has a temperature sensor for capturing the temperature inside the sensor head and is configured to do at least one of:

store a predetermined number of temperature values captured last from inside the sensor head, or store at least one of the maxima or minima of the captured temperature inside the sensor head each with a time stamp in a value history in the data memory.

13. The detector as claimed in claim 10, wherein the sensor head is configured to register predetermined events and to store each of them with a time stamp as an event history in the data memory.

14. The detector as claimed in claim 8, wherein the sensor head or at least one of the sensor heads is configured to carry out a self-calibration on the basis of the reception of a corresponding control command, and wherein the control commands comprise a command to carry out the self-calibration.

15. The detector as claimed in claim 1, wherein the evaluation unit is configured to transmit a request signal to the plurality of sensor heads by a plurality of first interfaces and to receive sensor head data from a memory of the sensor heads in response to the request signal.

16. The detector as claimed in claim 15, wherein the evaluation unit is configured to identify the sensor heads connected by the respective first interface depending on the received sensor head data.

17. The detector as claimed in claim 6, wherein the dedicated third interface is configured to connect a configuration device for at least one of: supplying, reading or processing one, a plurality of or all of the following: configuration parameters, sensor head data, contents of the data memory of the sensor head, configuration data, firmware, control commands.

18. The detector as claimed in claim 2, wherein the evaluation unit is configured to receive one, a plurality of or all of the following from the alarm signal receiving device by the at least one second interface: configuration parameters, sensor head data, configuration data, firmware, control commands.

19. The detector as claimed in claim 5, having one or more hardware switches for manually selecting the configuration parameters for the first interfaces, to which the sensor heads are to be connected.

20. The detector as claimed in claim 5, wherein the evaluation unit is configured to carry out a configuration mode for identifying the sensor heads connected to the evaluation unit and for automatically selecting suitable configuration parameters on the basis of the identification of the connected sensor heads and has at least one switching element which can be controlled manually from the outside, and is intended to activate the configuration mode.

21. The detector as claimed in claim 1, wherein the sensor heads are configured to capture electromagnetic radiation from at least one of: sparks or flames, a temperature of at least one of: ambient temperature or housing temperature inside the sensor head, at least one of gas concentrations, gas compositions or concentration changes of particular gaseous components of combustion gases, thermal decomposition products, toxic or flammable gases, or aerosols, including smoke aerosols.

22. The detector as claimed in claim 1, wherein the sensor heads each have a signal processing unit which is configured to normalize a hazard signal and to transmit it as a normalized sensor head output signal to the evaluation unit.

23. A fire detection system, having at least one modular multi-sensor fire detector as claimed in claim 21 and an alarm signal receiving device which is in signal communication with the modular multi-sensor fire and/or spark detector and is spaced-apart from it.

* * * * *